US009415987B2

(12) United States Patent
Cox

(10) Patent No.: US 9,415,987 B2
(45) Date of Patent: Aug. 16, 2016

(54) CONTAINER OPENING DEVICE AND METHOD OF USE

(71) Applicant: Robert Cox, Sheboygan, WI (US)

(72) Inventor: Robert Cox, Sheboygan, WI (US)

( * ) Notice: Subject to any disclaimer, the term of this patent is extended or adjusted under 35 U.S.C. 154(b) by 0 days.

(21) Appl. No.: 14/476,707

(22) Filed: Sep. 3, 2014

(65) Prior Publication Data

US 2016/0060085 A1 Mar. 3, 2016

(51) Int. Cl.
*B67B 7/16* (2006.01)
*B67B 7/40* (2006.01)

(52) U.S. Cl.
CPC ..... *B67B 7/403* (2013.01); *B67B 7/406* (2013.01)

(58) Field of Classification Search
CPC ..... B67B 7/16; B67B 7/14; B67B 7/44; B67B 7/403; B67B 7/406
USPC ..... 81/3.27, 3.55, 3.57, 3.41, 3.47, 3.48
See application file for complete search history.

(56) References Cited

U.S. PATENT DOCUMENTS 55,878 A * 6/1866 Livermore ..... 81/3.57
941,865 A * 11/1909 Forsyth et al. ..... B67B 7/16 81/3.55
3,495,284 A * 2/1970 Weingardt ..... B67B 7/16 30/298
D308,322 S * 6/1990 Borden ..... D8/40
4,949,600 A * 8/1990 Tricinella ..... 81/3.09
4,967,436 A * 11/1990 Russell ..... 7/156
5,169,305 A * 12/1992 Kee ..... 431/253
5,222,265 A * 6/1993 Hermansson ..... 7/156
5,535,644 A * 7/1996 Paul-Alexandre et al. .... 81/3.09
5,771,759 A * 6/1998 Warren ..... 81/3.09
6,865,761 B2 * 3/2005 Henke et al. ..... 7/151
7,363,837 B1 * 4/2008 Odell ..... 81/3.09
7,779,729 B2 * 8/2010 Pella et al. ..... 81/3.57
7,827,884 B2 * 11/2010 Lawson ..... 81/3.09

* cited by examiner

*Primary Examiner* — Hadi Shakeri
*Assistant Examiner* — Danny Hong
(74) *Attorney, Agent, or Firm* — Mandy T. Garrels; Ceres Patent & Technology LLC

(57) ABSTRACT

The invention herein provides for a tab lifting and leveraging device for opening a pop top or pull top container wherein said pop top or pull top container is of hand held size and having a sealed opening and a lift tab located on its top surface. Said tab lifting and leveraging device of the invention herein comprising a planar length of solid durable material having at least a length and a width. Said device further having a bottom edge, a top edge, a proximate side edge, a distal side edge, a prying element, a rear groove, a recessed fulcrum point, and a handle. When in use, said prying element is fitted through said lift tab and lifted at a given angle against the container surface.

5 Claims, 4 Drawing Sheets

CONTAINER OPENING DEVICE AND METHOD OF USE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

CROSS REFERENCE TO RELATED APPLICATIONS

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

1. Field of the Invention

The disclosed invention herein pertains to a container opening device specifically for containers having a tab style release system.

2. Background

Containers having a tab style release system, specifically those for general consumer use, tend to be designed for hand held application. Typically, these containers have an air tight seal with various methods for opening and accessing content within. These containers are mass manufactured with little variation between their designs. Typically, hand held food containers such, particularly aluminum food containers, provide a lift tab attached to the top surface of the container. When lifted by the user's finger, the tab is leveraged against a prescribed air tight sealed opening, breaking said sealed opening and creating access to the content within. The tab style release mechanism is popular with aluminum containers because their durable and malleable qualities allow for manufacture of a food safe breakable air tight seal.

From an ergonomic standpoint, tab style release caters to the general population who are able to lift an aluminum tab with a finger and leverage said tab against a sealed opening with minimal force. Secondary problems arise however in the act of lifting and leveraging said tab. The act of lifting the tab requires a user to pry the tab away from the flat surface of the container top. In this process, if the user has long fingernails, the fingernails are subject to damage (chips or breaks). In other cases, the user may not have the benefit of long thin finger nails to sleeve under the tab for a better grip. In these instances, greater force is exerted by the user's hands and fingers. Populations that suffer from joint pain issues or who have less motor control over phalangeal and carpal movement would have greater difficulty in the simple task of opening these types of containers. A user's difficulty or inability to achieve such simple tasks negatively impacts their day to day independence and lifestyle. As such, tools that bridge the ergonomic gap, having minimal change over the interaction between the user and the container, offer effective and efficient solution to the problem.

A common device in the prior art for opening drinking containers having a pop tab opening provides for a sleeve design. According to this style of tool design, a sleeve like feature having a top and bottom portion is positioned at a bottom end of a length of solid material such that a lift tab is positioned planarly between said top and bottom portion and lifted upward. According to the disclosures of the claimed art falling within this sleeve like category, the fulcrum point is located between said top and bottom portion where said lift tab would be sandwiched within. See U.S. Pat. Nos. 4,563,919, 4,949,600, D405,331, U.S. Pat. No. 7,089,825, D307,861, U.S. Pat. No. 4,524,646, D487,558, D454,287.

An alternative device provides for a length of solid material having a thin wedged end. See U.S. Pat. No. 4,563,919, D431166, D488969, D479965, U.S. Pat. No. 7,363,837. The thin wedge end is designed to sleeve under said lift tab and lift said lift tab upward. As with the above referenced prior art, the fulcrum point and said thin wedge are on the same location of the device. The position of the fulcrum requires an unnatural movement of the user's arm. Further, this design is not portable and can be dangerous around children with its pointed wedge end.

The ideal tool for opening tab containers should require minimum movement of the user's hand or body and provide leverage support to said container. The tool should also be portable, accommodating the variety of locations in which food containers are used by any individual throughout a day. Current tools in the market and in the prior art attempts to address these concerns but fall short in their ergonomic qualities.

SUMMARY OF THE INVENTION

The invention herein relates to a device and method that aids in the opening of hand held tab containers. Said tab container comprising a sealed opening or cover that is released by a lift tab. Said tab container may comprise but is not limited to standard aluminum drinking cans, soup cans or potato chip cans. The lift tab may be of the type that pops a sealed opening or peels away an attached sealed cover. Specifically, the lift tab contemplated herein pertains to the standard type found on food cans or drinking cans of approximately one to one and a half inches long, less than one inch wide, having at least a top hole and often times a bottom hole and a central bridge, comprising a contiguous piece of durable or semi-durable material. The combination of claimed features of this invention designed specifically to provide reinforced leverage to the bridge portion of said lift tab.

The invention herein provides for a tab lifting and tab leveraging device for opening a pop top or pull top container wherein said pop top or pull top container is of hand held size and having a sealed opening and a lift tab located on its top surface. Said lift tab is positioned adjacent to said sealed opening. Said lift tab comprising a length, a width, a top surface facing the ambient environment, a bottom surface facing said top surface of said container, a top end and a bottom end and at least one hole located near the top end of said lift tab where a user's finger or said device is sleeved through so as to actuate lifting action of said lift tab. Said tab lifting and tab leveraging device of the invention herein comprising a planar length of solid durable material having at least a length and a width. Said device further having a bottom edge, a top edge, a proximate side edge, a distal side edge, a prying element, a rear groove, a recessed fulcrum point, and a handle.

Said prying element extends from the corner angle between said proximate side edge and said bottom edge, said rear groove is rearward of said prying element along said bottom edge, said fulcrum point is rearward of said rear groove and furthest opposite of said prying element. Said handle rises vertically above said bottom edge at no less than a 45 degree above horizontal from said distal side edge.

When in use, said prying element is fitted through the top hole of the lift tab from its exterior surface (facing opposite of the can's top surface towards the ambient environment) towards its interior surface (facing the container's top surface). The rear groove rests flushly over the exterior surface of the bottom half of the lift tab. The bottom half of the lift tab comprising the bridge and the area below said bridge of said tab handle. Said rear groove provides sufficient room to allow the prying element to fit completely through said top hole of the tab handle and allowing the lower portion of said bottom edge of the device to rest flushly against the bottom half of said lift tab. This allows the bottom edge of the device to securely and comfortably reinforce leverage of the lift tab against the resistance of the container surface. By lifting said lift tab to a near perpendicular position against the container surface, the bottom edge flushly resting against the exterior surface of said tab handle, reinforcement to an otherwise overlooked and weaker area of the lift tab (from the bridge and downward) is provided.

The length of said device provides a leveraging handle with a minimum preferred rotational capability of 45 degrees from horizontal and maximum 270 degree from horizontal relative to a standard cylindrical container. The fulcrum for this method and device is defined by the angle intersection between said distal side edge and said bottom edge. Note that the prior art does not disclose a separate or displaced fulcrum designed into the invention. The angle between the bottom edge of said device and its handle will determine the rotational range around the fulcrum and the container. For example, a handle extending upward and forward from the horizontal plane of said bottom edge in a "J" shape will allow the device handle and the lift tab to move a full 180 to 270 degrees from one end of the planar horizontal surface to the other end of said planar horizontal surface or to the vertical side surface of said container. In contrast, an "L" shaped handle is able to move between 90 to 180 degrees from said planar horizontal surface of the container downward until it is obstructed by either the edge of the container or the vertical side surface of the can. The range of rotational movement is important for ergonomic ease (maximizing the effect of wrist movement and eliminating forearm movement), increased range of movement of said lift tab, and increased leveraging force against said lift tab by the wider range of rotation. The spirit of this invention according to the disclosure herein should apply towards any lift tab container and situation that fits the problem sought to be solved herein. The intention of this invention is to improve ergonomic experience, portability and establish a new method of use and device.

The effect of the invention herein provides an independent fulcrum point for wider range of wrist motion, added reinforcement and leverage to an otherwise weak section of said tab handle, added downward pressure by single wrist motion and added control of force and movement. This improvement may be contrasted against prior art that do not disclose a displaced fulcrum in the design and wherein the user's body would function as the fulcrum, compromising ergonomic ease.

Additional elements may be added to improve the needs of a particular application. For example, the prying element may comprise a barbed hook embodiment wherein a secondary barb hook is located rearward of said prying element curled downward and inward towards the proximate side edge to serve as a retainer hook when opening larger containers such as soup cans. This feature is helpful in preventing a larger and heavier grade lid from springing away from the user when it is pulled away from the container. When pulling the top surface of a soup can away from the can, the top surface would remain attached to the device resulting in a clean and controlled experience.

The device is preferably comprised of solid durable material such as plastic, metal, wood, etc. According to a preferred embodiment, the device may have specific application for drinking containers (soda cans, beer cans, juice cans, etc.) wherein the device may be sized to fit an individual's palm and fitting onto a key chain or army knife for portability and advertisement benefits. Alternatively, a larger sized and less portable device may be devised to manage more durable containers and at home needs. The handle may be an ideal location on the device for graphic art or printed marketing material. Said device may be quickly and inexpensively manufactured by molding, die cutting, printing, extrusion, laser cutting processes, or any known method of art at the time.

DETAILED DESCRIPTION OF THE PREFERRED EMBODIMENTS

Reference will now be made in detail to exemplary aspects of the present invention which are illustrated in the accompanying drawings. Wherever possible, the same reference numbers will be used throughout the drawings to refer to the same or like parts.

Figure 1:
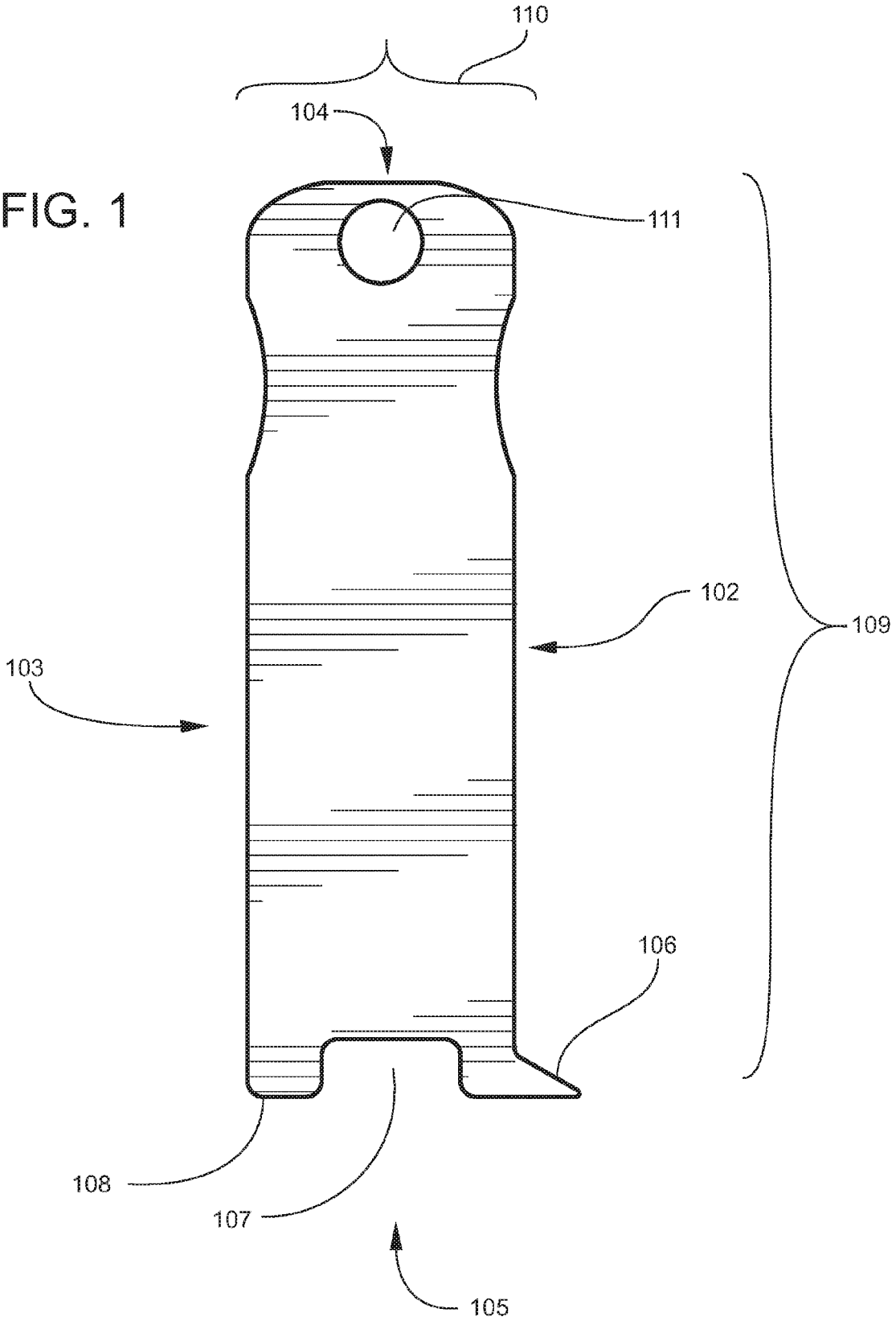
FIG. 1 is a right side plan view of an exemplary illustration of the invention herein.

FIG. 1 provides an exemplary illustration of the invention herein. A right side plan view of the invention is provided in FIG. 1 showing a proximate side edge 102 located to the right, a distal side edge 103 located to the left, a top side edge 104, a bottom side edge 105, a prying element 106 at the intersecting corner between the bottom side edge 105 and the proximate side edge 102, and a rear groove 107 located behind or rearward of said prying element 106. According to the embodiment of FIG. 1, said rear groove is located centrally along the planar length of said bottom side edge 105. The fulcrum point 108 in this embodiment being located at the bottom edge corner 108 opposite to the prying element 106.

The device according to the embodiment of FIG. 1 further comprising a length 109 of approximately 3 to 3.5 inches in length and approximately 1 inch in width 110 at the top side edge. The actual size of said device should not be limited by embodiment disclosure of FIG. 1 and may any desired dimension. The device of FIG. 1 fits within the palm of an adult hand and also is easily portable on a key chain. A key ring hole 111 is provided in FIG. 1 for this purpose. The distance between the start of the rear groove and the end of the backside of the prying element (looking inward from the proximate side edge from left to right on FIG. 1) as well as the total width of the bottom side edge is sufficient to allow the prying element to reach underneath the lift tab of a drinking container and concurrently provide reinforcement leverage against the bridge of said lift tab, fitting entirely along the length of said lift tab. This is because the surface area coverage by the bottom edge of said device is equal or longer than the length of said lift tab, being sufficiently long to fit underneath said lift tab to provide necessary reinforcement to weaker areas.

Figure 2:
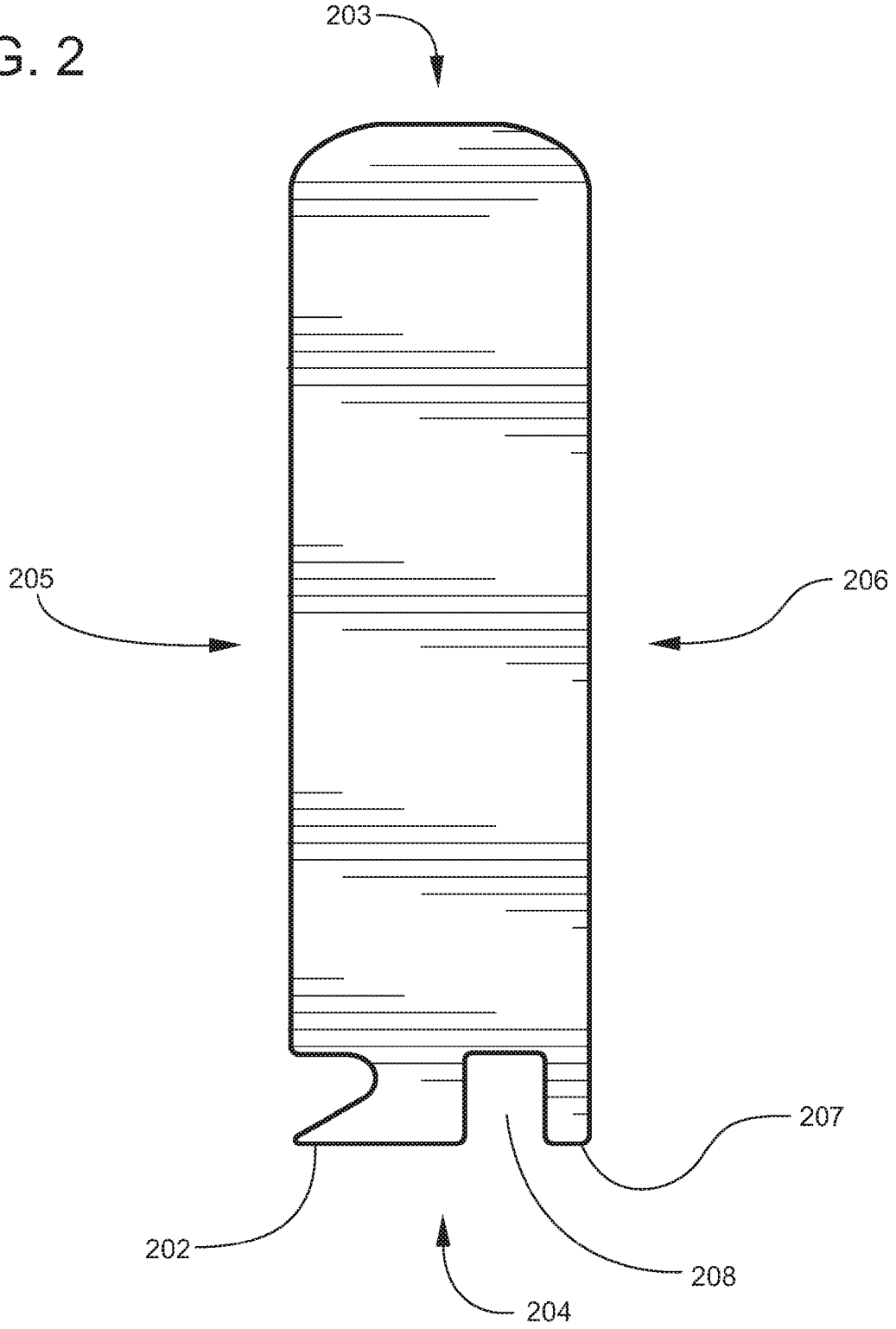
FIG. 2 is a left side plan view of an alternative embodiment of the invention herein.

FIG. 2 provides an alternative view and embodiment of the device similar to that of FIG. 1 with the exception of the location of the prying element 202. Similar to FIG. 1, FIG. 2 provides a device having a top side edge 203, a bottom side edge 204, a proximate side edge 205 and a distal side edge 206. In any case, the proximate side edge 205 being the edge closest to the prying element 202 and the distal side edge 206 furthest away from said prying element 202. The perspective in this case is a left side view of the device wherein the proximate side edge 205 and prying element 202 is located to the left and the fulcrum 207 is located to the right. In the case of FIG. 2, the prying element 202 does not extend beyond the vertical plane of the proximate side edge but rather is recessed within the rectangular silhouette of the device. As a consequence, the rear groove 208 is less wide. This embodiment specifically intended for opening drink containers.

Figure 3:
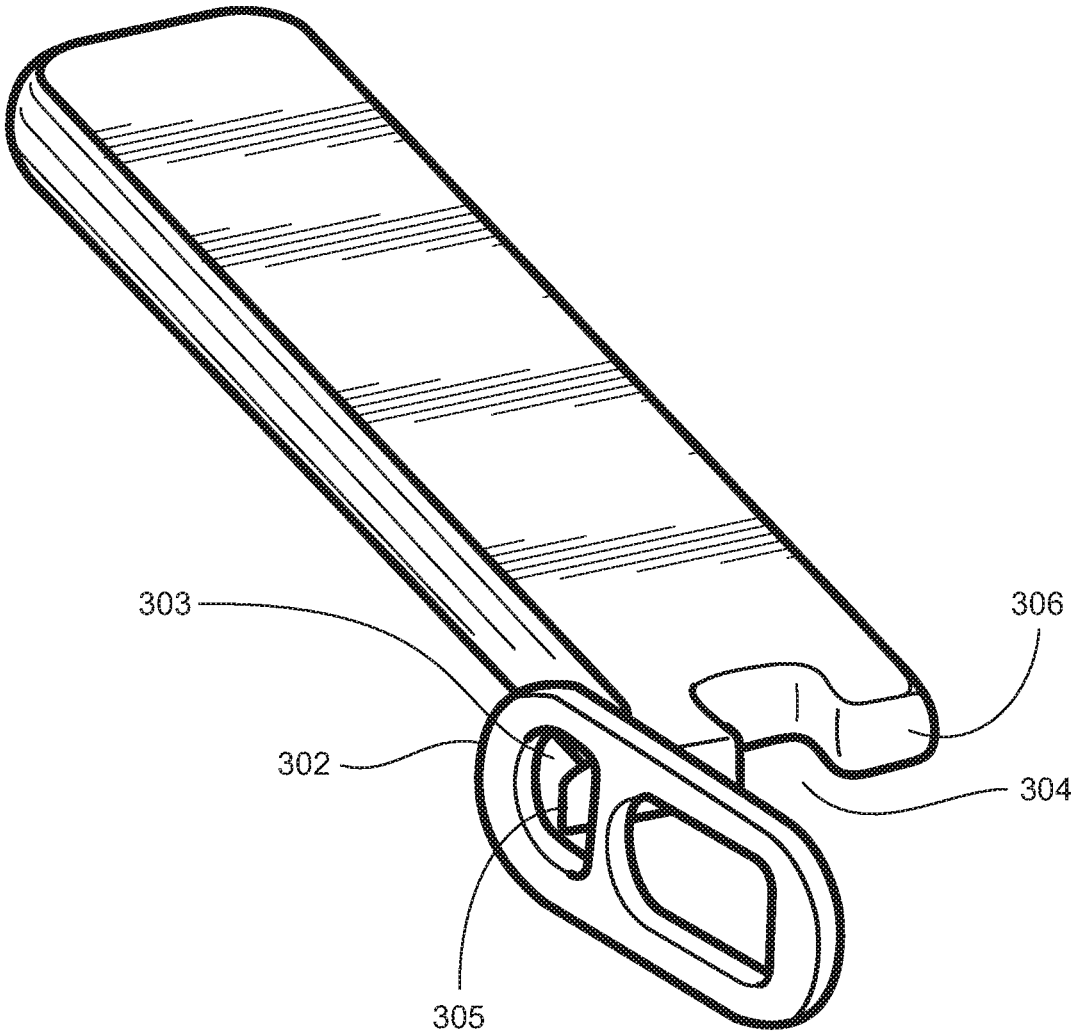
FIG. 3 is a left side perspective view of an alternative embodiment of the invention herein.

FIG. 3 provides a three dimensional illustration of the device in use with a standard lift tab 302 of a drinking container. As described above, the prying element is slid underneath and through the top hole 303 of said lift tab, the rear groove 304 allows the prying element 305 to slide completely through said top hole 303 while enabling the remaining bottom portion of the bottom edge to rest flushly against the lift tab for reinforcement affect. The fulcrum 306 or pivot point is located at the corner opposite to the prying element.

Figure 4:
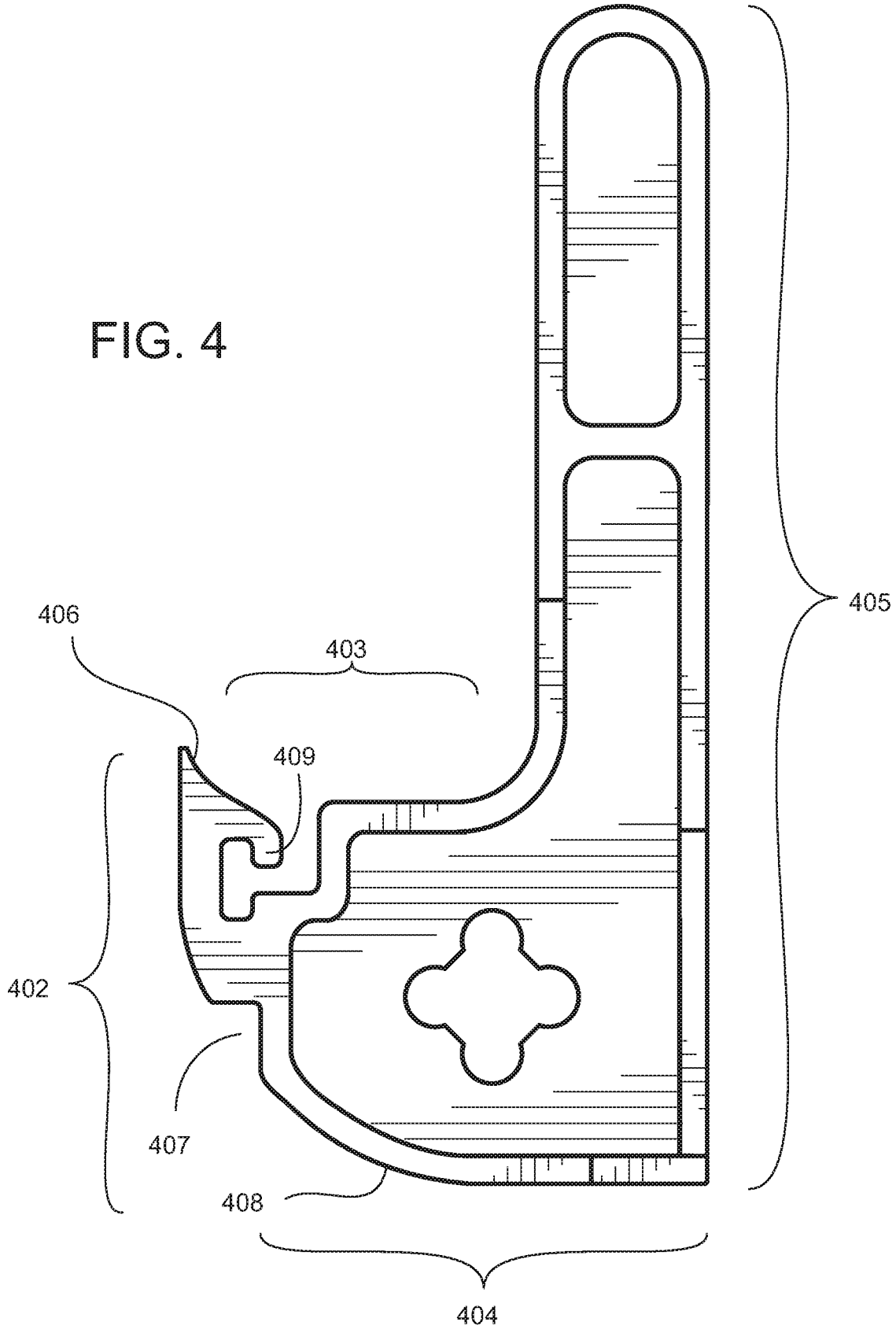
FIG. 4 is a rotated plan view of an alternative embodiment of the invention herein.

FIG. 4 provides an alternative embodiment of the device having a "J" shape. FIG. 4 providing a rotated plan side view of the device having a bottom side edge 402, a proximate side edge 403, a distal side edge 404 and a laterally elongated top end 405 extending beyond the proximate side. As with FIGS. 1 and 2, the prying element 406 is located at the proximate corner of said bottom side edge 402 and the rear groove 407 is positioned rearward of said prying element 406. The corner opposite of said prying element 406 provides the fulcrum 408 or pivot point. In this case however, the lift tab 405 is bent forward beyond the proximate side 403 of the device (to the left in FIG. 4) such that the device may rotate over its fulcrum point 408 a full 180 degree between a proximate side (closest to said prying element) to a distal side (side furthest from said prying element) of horizontal. Since the planar direction of the handle 405 is parallel with the planar direct of the prying element 406 and bottom edge 402, both prying element and handle will travel the same range of distance or angle over the fulcrum point 408. As such, specifically for more durable and larger containers such as soup cans where a lifting action is required, added reinforcement and leverage is provided to the lift tab and its bridge. The "J" shape which enables a full 180 degree rotational movement allows the user to twist open the container lid with a single wrist action rather than having to lift and pull in the traditional manual way. An added element of a barb hook 409 is provided also in FIG. 4, specifically to improve the experience of opening larger more durable container lids such as soup cans. The barb hook 409 holds onto the lift tab through its top opening during and after the tab is lifted and the lid is removed from the container.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

I claim the following invention:

1. A can opening device that aids in for opening a hand held container with a sealed opening and a lift tab, said lift tab comprises at least one hole centrally therethrough, said device comprising:

a length of durable nonflexible material with a first end surface and a second end surface, a first side and a second side, wherein said first side and said second side extend the width of said device and said first end surface and said second end surface extend the length of said device, said length forming a handle, said length of said device is greater than its said width said first side defining a straight edge extending from said first end surface to said second end surface, said first side providing a fulcrum, a groove and a prying element, said prying element comprising a narrow wedge extending from said first end surface beyond and perpendicular to said first end surface, said groove being positioned between said fulcrum and said prying element, said device being engageable with said lift tab whereby said prying element is fitted through said at least one hole and said groove positioned over said lift tab providing sufficient room to allow said prying element to fit completely through said at least one hole, whereby pivoting said handle on said fulcrum by an angle of 45 degrees or greater pierces said sealed opening.

2. A can opening device of claim 1 wherein said handle extends vertically above said first end at an angle ranging from 45 degrees to 135 degrees.

3. A can opening device of claim 1 wherein said prying element further comprising a hook element positioned above said narrow wedge in rearward fashion such that said prying element is positionable through and under said hole at said top end of said lift tab, said top end of said lift tab being retainable on said prying element by its said hook element when said lift tab is removed from said hand held container.

4. A can opening device of claim 1 wherein said container further comprising a rim edge around the circumference of its top surface, said rim edge raised above said top surface forming a lip, said groove of said can opening device having a depth and width no less than the height and width of the said lip.

5. A can opening device of claim 1 wherein said first edge is at least one inch wide.

* * * * *